United States Patent [19]

Krueck et al.

[11] 4,367,673

[45] Jan. 11, 1983

[54] SYSTEM AND METHOD FOR CONTROLLING THE ELEVATION OF A BOOM HOIST DEVICE

[75] Inventors: John F. Krueck, Mansfield; Donald G. Braden, Galion; William J. Askins, Lexington, all of Ohio

[73] Assignee: Dresser Industries, Inc., Dallas, Tex.

[21] Appl. No.: 223,870

[22] Filed: Jan. 9, 1981

[51] Int. Cl.[3] ..... F15B 11/08

[52] U.S. Cl. ..... 91/437; 91/420; 91/452; 91/464

[58] Field of Search ..... 91/420, 437, 452, 464, 91/471

[56] References Cited

U.S. PATENT DOCUMENTS

| | | | |
|---|---|---|---|
| 2,328,980 | 9/1943 | Herman | 91/420 |
| 3,033,168 | 5/1962 | Ruhl | 91/420 |
| 3,381,587 | 5/1968 | Parquet | 91/420 |
| 3,523,490 | 8/1970 | Bianchetta | 91/420 |
| 3,788,401 | 1/1974 | Scheidt et al. | 172/801 |
| 3,887,160 | 6/1975 | Cusveller | 91/420 X |
| 3,908,515 | 9/1975 | Johnson | 91/420 |
| 4,024,796 | 5/1977 | Theobald | 91/437 X |
| 4,034,815 | 7/1977 | Dezelan | 91/437 X |
| 4,039,085 | 8/1977 | Livengood | 91/420 X |
| 4,165,675 | 8/1979 | Cryder et al. | 91/420 |
| 4,167,892 | 9/1979 | Cryder et al. | 91/445 |

*Primary Examiner*—Robert G. Nilson

*Attorney, Agent, or Firm*—J. N. Hazelwood; B. E. Deutsch

[57] ABSTRACT

A multi-purpose lifting vehicle includes a hydraulic cylinder for controlling the elevation of a boom hoist device operably connected thereto. The device is alternately used in crane or front end loader modes of operation. The vehicle includes a hydraulic system for controlling the operation of the cylinder comprising a multi-position mode selector valve for selecting the specific mode of operation of the boom hoist device for raising, lowering and enabling the boom hoist device to float. The control system further includes a holding valve for locking the hydraulic fluid within the raising end of the cylinder for maintaining the elevation of the boom hoist device. A first bypass circuit is provided about the holding valve for enabling fluid to escape from the raising end of the cylinder while fluid is simultaneously flowing to the lowering end thereof. A two-position valve having a closed position for preventing flow of fluid through the valve when the selector valve is in either its raising or lowering positions and an open position for establishing a bypass path about the holding valve when the selector valve is in its float position for enabling fluid to flow to the raising end from the lowering end of the cylinder or to the lowering end from the raising end thereof in accordance with changes of contour of the terrain over which the lifting vehicle is advancing.

1 Claim, 1 Drawing Figure

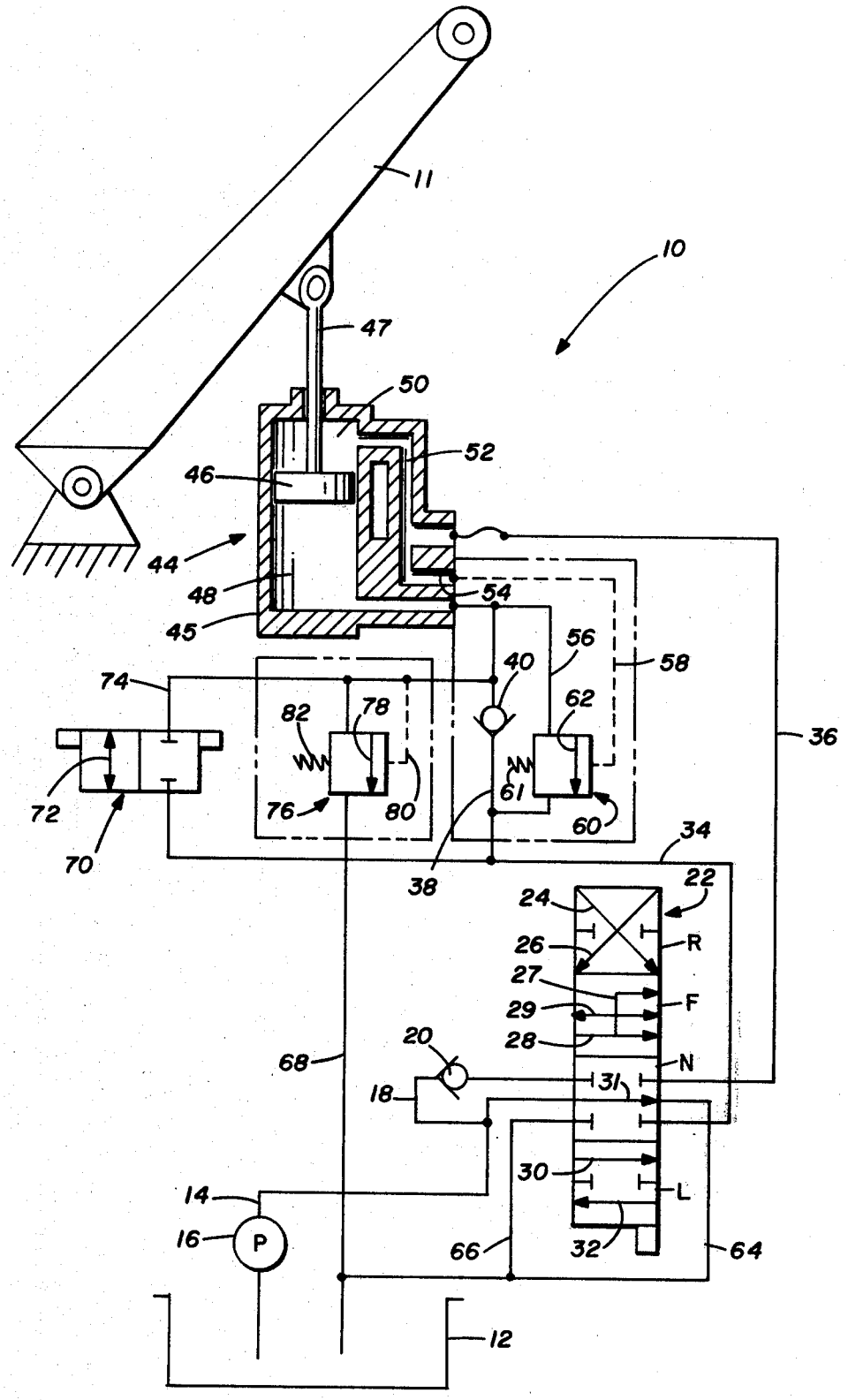
11
10
47
50
52
46
44
48
54
45
56
58
40
74
82
78
62
36
72
76
80
61
60
70
38
34
22
24
26
R
27
29
F
28
20
68
N
18
31
30
L
14
16
P
66
32
64
12

SYSTEM AND METHOD FOR CONTROLLING THE ELEVATION OF A BOOM HOIST DEVICE

BACKGROUND OF THE INVENTION

This invention relates to a multi-purpose lifting vehicle having a boom hoist device with a hydraulic elevation control, and more particularly, to a control system for said hydraulic elevation control.

Multi-purpose lifting vehicles are designed to accept various attachments to enable the vehicle to be utilized in lifting different types of material. For example, the vehicle may be used as a crane when outfitted with a tote boom attachment, or employed as a front end loader with a bucket attachment. In either case, the vehicle's boom hoist device is employed to raise or lower the boom or bucket respectively.

When the vehicle is utilized as a crane, the hydraulic fluid used as the actuating medium in the control system should be locked in the raising end of the hydraulic cylinder. The cylinder is attached to the boom hoist device for controlling the elevation thereof. The hydraulic fluid maintains pressure within the raising end of cylinder to prevent the load bearing hook attached to the boom hoist device from unintended downward movement.

When the vehicle is used as a front end loader, it is desirable to have the bucket and boom hoist device connected thereto "float", that is move downwardly or upwardly in accordance with changes of contour of the terrain over which the vehicle is advancing. Since the bucket, in the front end loader mode of operation, is generally in contact with the terrain, allowing the bucket to float prevents the bucket from losing contact with the ground when a depression is encountered, or raising the front axle of the vehicle if a rise in the terrain is encountered.

Accordingly, the need exists for a control for the hydraulic system which controls elevation of a boom hoist device regardless of the operating mode of the vehicle.

SUMMARY OF THE INVENTION

Accordingly, it is an object of this invention to control the elevation of boom hoist device employed on a multi-purpose lifting vehicle.

It is a further object of this invention to control the elevation of a boom hoist device selectively operable in either crane or front end loader modes of operation.

It is a further object of this invention to lock the boom hoist device in a selected elevation when the boom hoist device is employed in a crane mode of operation and to permit the boom hoist device to float when the device is employed in a front end loader mode of operation.

These and other objects of the present invention are attained in a multi-purpose lifting vehicle having hydraulic cylinder means for controlling the elevation of a boom hoist device operably connected thereto. The device is alternatively used in crane or front end loader modes of operation. A control system for the cylinder means includes a holding valve for locking the hydraulic fluid within the raising end of the cylinder means for maintaining raised elevation of the boom hoist device. A first bypass circuit is established about the holding valve for enabling fluid to escape from the raising end of the cylinder means while fluid is simultaneously flowing to the lowering end thereof. The control system further includes a two-position valve having a closed position for preventing flow of fluid through the valve when a selector valve employed to determine the mode of operation of the boom hoist devices is either in its raise or lower positions. The two-position valve is in its open position for establishing a second bypass circuit about the holding valve when the selector valve is in its front end loader float position for enabling the boom hoist device to float.

The present invention further includes a method of controlling the elevation of a boom hoist device employed on a multi-purpose lifting vehicle wherein the boom hoist device is operably connected to hydraulic cylinder means. The boom hoist device is alternatively employed in crane or front end loader modes of operation. The method includes directing hydraulic fluid to a raising end of the cylinder means for raising the boom hoist device; preventing the fluid from exiting from the raising end of the cylinder means when the boom hoist device is raised to its desired elevation; establishing a first bypass path through which fluid can exit from the raising end of the cylinder means while fluid is simultaneously flowing to a lowering end thereof; and establishing a second bypass path operable when the vehicle is employed as a front end loader for enabling the boom hoist device to float.

BRIEF DESCRIPTION OF THE DRAWING

The single FIGURE of the drawing schematically illustrates a control system for controlling the elevation of a boom hoist device employed on a multi-purpose lifting vehicle.

DESCRIPTION OF THE PREFERRED EMBODIMENT

Referring now to the drawing, there is disclosed a preferred embodiment of the present invention. In particular, there is disclosed a control system 10 for a multi-purpose lifting vehicle having hydraulic cylinder means 44 for controlling the elevation of a boom hoist device 11 connected thereto. The cylinder means is illustrated as a double acting motor having a piston end 48 which may be termed the "raising" end and a rod end 50 which may be termed the "lowering" end. The use of the terms indicates introduction of fluid into the specific end results in the boom hoist device moving in the specified manner. The vehicle may be alternatively used as either a crane or as a front end loader.

Control system 10 includes sump 12 serving as a source of hydraulic fluid. Pump 16 delivers hydraulic fluid from sump 12 through line 14 to the inlet side of mode selector valve 22. Valve 22 includes a movable spool having a plurality of conduits, with movement of the spool selectively aligning one or more of the conduits which are selectively movable into alignment with the inlet and outlet from the valve to determine the mode of operation of the control system. Such internal conduits provide a boom hoist device raise (R), lower (L) and float (F) modes of operation for the boom hoist device, and thus the multi-purpose lifting vehicle. The valve further includes a neutral position (N) (the position actually illustrated in the drawing) to provide free flow of fluid from pump 16 to sump 12.

The raise position (R) of valve 22 includes internal conduits 24, 26; the float position (F) includes conduits 27, 28, and 29, the lower position (L) includes conduits 30 and 32, and the neutral position (N) includes conduit 31. The arrows on the various conduits of valve 22 indicate fluid flow direction through the conduits. For example, when it is desired to lower boom hoist device 11, conduits 30 and 32 of valve 22 are respectively aligned with lines 18 and 66, thereby placing line 18 in communication with line 36, and line 66 in communication with line 34. The overall manner in which valve 22 functions shall be more fully explained hereinafter.

Conduit 34, connected to valve 22, communicates with conduit 38. This conduit is part forms a first flow path communicating the selector valve with hydraulic cylinder means 44. A unidirectional flow control valve 40, illustrated as a check valve, is disposed within conduit 38 to regulate flow of fluid therethrough. Flow control valve 40 permits fluid to flow from conduit 34 through conduit 38 to raise end 48 of hydraulic cylinder means 44. The valve further prevents reverse flow of fluid from raise end 48 of the cylinder means through conduit 38 and thence into conduit 34.

Conduit 56, having normally closed valve 60 controlling the flow of fluid therethrough defines a bypass path about valve 40 from raise end 48 of cylinder means 44. As shall be more fully explained hereinafter, when hydraulic fluid is flowing through pilot line 58, a pressure is developed to move internal conduit 62 of valve 60 into alignment with conduit 56 to open the bypass path.

As noted previously, conduit 36 communicates with selector valve 22. The conduit is also in communication with lowering end 50 of hydraulic cylinder means 44 through conduit 52. A second internal conduit 54 is formed within the housing and is in communication with conduit 52, and also with pilot line 58. When hydraulic fluid flows from valve 22 through conduit 36 and external conduit 52, a parallel flow is also established through conduit 54 and thence through conduit 58.

Control system 10 further includes a second normally closed valve 70. Valve 70 includes an internal conduit 72 which is selectively movably aligned with conduits 34 and 74 for placing the valve in an open condition. The valve may be manually or automatically placed into an open condition for a reason to be more fully explained hereinafter. In the present embodiment, valve 70 is manually operated. Conduit 72 of valve 70 permits flow of fluid in either direction through the valve. As conduit 74 communicates through conduit 38 with raised end 48 of hydraulic cylinder means 44, valve 70 when in an open state, establishes a second bypass path about flow control valve 40.

A normally closed thermal relief valve 76 is also provided. Valve 76 includes a conduit 78 which is aligned with conduits 74 and 68 to place valve 76 in an open condition. Valve 78 opens when the hydraulic pressure within line 74 becomes excessive due to an increased temperature of the hydraulic fluid. Pilot line 80 provides hydraulic fluid to the valve for generating a force to overcome the force provided by spring 82. The spring is employed to maintain the valve in its normal state.

Conduits 64, 66 and 68 are provided for returning hydraulic fluid to sump 12. As illustrated, when valve 22 is in its neutral position, conduits 14 and 31 are in communication with conduit 64 for permitting free circulation from pump 16 to sump 12.

OPERATION

In operation, hydraulic fluid contained within sump 12 is delivered by pump 16 through conduit 14 to mode selector valve 22. When the mode selector valve is in its raise mode of operation, internal conduits 24 and 26 are aligned respectively with conduits 18 and 36 for respectively delivering hydraulic fluid through conduit 34 to raising end 48 and returning hydraulic fluid from lowering end 50 via conduits 36 and 66 to the sump.

The hydraulic fluid delivered through conduit 34 flows through conduit 38 and develops a pressure to open check valve 40 and flows into raising end 48 of hydraulic cylinder means 44. The fluid within raising end 48 develops a pressure acting on piston 46 to move the piston upwardly and raise boom hoist device 11 connected to rod 47 of the piston. Fluid contained within lowering end 50 of hydraulic cylinder means 44 is forced therefrom by the upward movement of the piston and flows through conduit 36, conduit 26 of valve 22 and conduit 66 to the sump. Spring 61 maintains valve 60 in its normally closed position as any fluid flow through pilot conduit 58 fails to generate a sufficient force to overcome the spring force. Similarly, valve 70 is in its normally closed position to prevent any fluid flow between conduits 34 and 74. Thus, any fluid delivered to raising end 48 of hydraulic cylinder means 44 is locked therewithin for maintaining the elevation of boom hoist device at a desired position, once additional fluid flow to raising end 48 of cylinder means 44 is discontinued.

When selector valve 22 is in its lowering mode of operation, conduit 30 is aligned with conduits 18 and 36 while conduit 32 is aligned with conduits 34 and 66. Thus, hydraulic fluid is delivered through conduits 18 and 36 into lowering end 50 of hydraulic cylinder means 44. Simultaneously, the hydraulic fluid is furnished through conduits 54 and 58 to valve 60 to place conduit 62 in alignment with conduits 56 and 34, providing fluid flow communication therebetween. As piston 46 is lowered through flow of hydraulic fluid to lowering end 50 of the cylinder means, hydraulic fluid is forced out of raising end 48 and flows through conduit 56 and 34 to conduits 32 and 66 to the sump. Valve 60, when opened as a result of the fluid pressure within pilot conduit 58, defines a bypass path about flow control valve 40. The raise and lower positions of mode selector valve 22 are employed when the multi-purpose lift vehicle is used as a crane, or to mechanically control movement of the boom hoist device when the vehicle is used as a front end loader.

When the vehicle is employed as a front end loader conduits 27, 28, 29 providing the float function of mode selector valve 22 are aligned respectively with conduits 36, 34 and 66, and 14 and 64. Simultaneously, valve 70 is opened (either manually or automatically) thereby placing conduit 72 in communication with conduits 34 and 74. The float mode of operation enables the bucket attachment employed on the vehicle as a front end loader to ride along the ground and follow the contour of the terrain.

With valve 22 in its float position, flow through conduit 18 and valve 20 is discontinued. The output from pump 16 is delivered via conduits 14 and 29, and 64 to sump 12. Conduit 36 communicates with conduit 28 of valve 22 and conduit 66. Further, conduit 27 of valve 22 communicates with both conduits 66 and 34. Conduits 27 and 28 are connected together to provide communication between conduits 36, 34 and 66.

In the float mode of operation, when the bucket attachment encounters a rise in the terrain, the bucket is lifted upwardly which in turn, causes piston 46 to move upwardly within cylinder means 44. The upward movement of the piston force hydraulic fluid from lowering end 50 through conduit 36 and thence into conduit 27. Since the upward movement of the piston has created somewhat of a vacuum in raising end 48 of the cylinder means, the fluid passing through conduit 27 follows the path of least resistance, thus flowing through conduits 28 and 34 valve 70 and conduit 74 into raising end 48 of cylinder means 44.

Similarly, when the bucket attachment moves across a depression in the terrain over which the multi-purpose vehicle is advancing, the bucket moves downwardly simultaneously forcing piston 46 downwardly within cylinder means 44. Fluid is forced from raising end 48 of the cylinder and passes through conduits 74, 72 and 34 to the mode selector valve. As conduit 34 is aligned with conduit 28 of the valve, the fluid flows through this conduit and passes into conduit 27 of the valve and thence flows through conduit 36 to lowering end 50 of the cylinder means as the downward movement of piston 46 creates somewhat of a vacuum within the lowering end. As mentioned previously, when the vehicle is employed as a front end loader and it is desired to control the raising and lowering of the bucket attachment valve 22 is selectively placed in its raise or lower positions to effect the desired movement of the bucket.

The utilization of valve 70 provides a normally closed bypass path about valves 40 and 60. Valve 70 is opened in the float mode of operation to permit fluid flow between the raising and lowering ends of cylinder means 44. The foregoing allows the boom hoist device to move freely upwardly or downwardly to follow the contour of the ground.

The control system herein described enables the multi-purpose lifting vehicle to be effectively operated as either a crane or as a front end loader. In the crane position, the control system effectively locks the boom hoist device at a desired elevation whereas in the front end mode of operation, the system effectively enables the bucket attachment to follow the contour of the terrain over which the vehicle is advancing.

While the preferred embodiment of the present invention has been described and illustrated, the invention should not be limited thereto but may be otherwise embodied within the scope of the following claims.

The embodiments of the invention in which an exclusive property or privilege is claimed are defined as follows:

1. A multi-purpose lifting vehicle having a boom hoist device which can be selectively used in a crane mode of operation or in a front end loader mode of operation, hydraulic cylinder means operably connected to the boom hoist device, and a hydraulic system for delivering hydraulic fluid to the hydraulic cylinder means, said hydraulic system comprising a sump serving as a source of hydraulic fluid; a mode selector valve having first, second, and third operating positions, pump means communicating with said sump for delivering hydraulic fluid from the sump to said selector valve, means defining a first flow path for returning hydraulic fluid to the sump from the selector valve, means defining a second flow path, including a one-way flow valve, for delivering hydraulic fluid from the selector valve to the raising end of said cylinder means and a first normally closed valve, which when placed in an open position, provides a first by-pass path about said one-way flow valve, means defining a third flow-path providing fluid communication between the selector valve and the lowering end of said cylinder means, and means defining a fourth flow-path including a second normally closed valve, which when placed in an open position, provides a second by-pass path about said one-way flow valve, said fourth flow-path providing fluid communication between said raising and lowering ends of said cylinder means through said selector valve, whereby when the control valve is in its first operating position it provides communication between, on the other hand, said pump means and said second flow-path, and, on the other hand, said third flow-path and said first flow-path to deliver fluid to the raising end of the cylinder means and to permit fluid to leave the lowering end of the cylinder means to raise the boom hoist device, and the one-way flow valve prevents reverse flow of fluid from the raising end of the cylinder means, whereas when the control valve is in its second operating position and said first normally closed valve is open communication is provided between, on the one hand, the raising end of the cylinder means and said first flow-path and, on the other hand, said pump means and the third flow-path to deliver fluid to the lowering end of the cylinder means and permit fluid to leave the raising end of the cylinder means to lower the boom hoist device and when said selector valve is in its third operating position and said second normally closed valve is open fluid communication is provided through said selector valve and said second normally closed valve between said raising and lowering ends of said cylinder means.

* * * * *